US007521877B2

(12) United States Patent
Suzuki et al.

(10) Patent No.: US 7,521,877 B2
(45) Date of Patent: Apr. 21, 2009

(54) DIMMER CIRCUIT FOR A DISCHARGE LIGHTING APPARATUS

(75) Inventors: Shinichi Suzuki, Kitasaku-gun (JP); Mitsuo Matsushima, Kitasaku-gun (JP)

(73) Assignee: Minebea Co., Ltd., Nagano (JP)

( * ) Notice: Subject to any disclaimer, the term of this patent is extended or adjusted under 35 U.S.C. 154(b) by 169 days.

(21) Appl. No.: 11/648,683

(22) Filed: Jan. 3, 2007

(65) Prior Publication Data

US 2007/0205728 A1 Sep. 6, 2007

(30) Foreign Application Priority Data

Mar. 3, 2006 (JP) ..... 2006-057698

(51) Int. Cl.
*G05F 1/00* (2006.01)

(52) U.S. Cl. ..... 315/291; 313/116; 313/580; 313/637; 362/346; 362/293; 315/224; 315/307; 315/219; 315/247; 315/360

(58) Field of Classification Search ..... 315/105–106, 315/119, 127, 136, 149–151, 154–156, 158–159, 315/169.1, 169.3, 194, 199, 200 A, 200 R, 315/206, 208, 209 PZ, 210, 219, 224–226, 315/227 R, 240, 244, 246–248, 250, 274–312, 315/314–315, 317, 318, 324, 360, 361, 362, 315/51, 56, 77, DIG. 4, DIG. 5, DIG. 7
See application file for complete search history.

(56) References Cited

U.S. PATENT DOCUMENTS 6,121,734 A * 9/2000 Szabados ..... 315/291
7,161,308 B2 * 1/2007 Kanno et al. ..... 315/291
2004/0239262 A1 12/2004 Ido et al.

FOREIGN PATENT DOCUMENTS

| | | |
|---|---|---|
| JP | A 2000-286090 | 10/2000 |
| JP | A 2001-357995 | 12/2001 |
| JP | A 2002-43088 | 2/2002 |
| JP | A 2002-359097 | 12/2002 |
| JP | A 2003-257694 | 9/2003 |
| JP | A 2003-347096 | 12/2003 |

* cited by examiner

*Primary Examiner*—Douglas W Owens
*Assistant Examiner*—Jae K Kim
(74) *Attorney, Agent, or Firm*—Oliff & Berridge, PLC

(57) ABSTRACT

There is provided a discharge lamp lighting apparatus including a dimmer circuit which is provided with a control means to dynamically adjust screen brightness according to an input signal, and a control means to adjust screen brightness based on a user's operation. The dimmer circuit includes: an amplitude adjusting circuit to superpose a first dimming control signal composed of a DC voltage onto a second dimming control signal composed of a pulse width modulation signal; an integration circuit to integrate an output of the amplitude adjusting circuit; and a comparison circuit to compare an output of the integration circuit with a triangular wave having a predetermined frequency thereby generating a dimming signal, wherein a burst dimming mode is performed according to the dimming signal.

3 Claims, 5 Drawing Sheets

DIMMER CIRCUIT FOR A DISCHARGE LIGHTING APPARATUS

BACKGROUND OF THE INVENTION

1. Field of the Invention

The present invention relates to a discharge lamp lighting apparatus to light a discharge lamp for illuminating a liquid crystal display (LCD) device, and more particularly to a discharge lamp lighting apparatus having a dimmer circuit which includes a control means to dynamically control screen brightness according to an input signal, and also a control means to control the screen brightness based on the user's operation, and which enables a dimming operation to be performed over a wide range without generating a brightness gradient even when a long lamp is used.

2. Description of the Related Art

A lighting apparatus such as a backlight device is employed in an LCD device used as a display device for an LCD monitor, an LCD television, and the like. A discharge lamp such as a cold cathode lamp is extensively used as a light source for such a lighting apparatus. A discharge lamp lighting apparatus is usually provided with an inverter circuit which includes a step-up transformer in order to generate a high AC voltage required to light a discharge lamp.

Many LCDs are so structured as to have screen brightness controlled according to the ambient environmental changes, and the like, such that the screen brightness basically is adjusted not only based on the user's operation but also dynamically adjusted according to continually changing input signals, wherein a voltage (or current) value out of a plurality of voltage (or current) values set for achieving respective predetermined screen brightness levels is appropriately selected by a switching operation according to a command signal sent from, for example, a microcomputer. The aforementioned control means to adjust the screen brightness based on the user's operation includes a burst dimming mode in which the oscillation operation of an inverter circuit is forcibly switched on and off so as to vary the ratio between on- and off-periods thereby performing a dimming operation, and the control means to dynamically adjust the screen brightness includes a current dimming mode in which the input DC voltage of an inverter circuit is varied by a DC-DC converter, or the like thereby varying the current of a discharge lamp connected at the secondary side of an inverter transformer.

In the burst dimming mode, the oscillation operation of an inverter circuit is intermittently switched on and off so as to vary the on-duty time (on-period per cycle) of on-off operation thereby controlling the average value of a current flowing in a discharge lamp. And in the current dimming mode, the value of a DC voltage supplied to the inverter circuit is varied so as to control the high current wave value of a lamp current flowing in the discharge lamp thereby controlling the brightness of the discharge lamp.

The current dimming mode has the following problem. When a lamp current is reduced in order to lower the brightness of a discharge lamp, a brightness gradient tends to be caused between the high tension side and the low tension side of the discharge lamp as shown in FIG. 4. Also, if a lamp current is reduced below the guarantee value of the discharge lamp, the discharge lamp exhibits an unstable discharge operation, which causes a problem of flickering, and also causes difficulty of maintaining a stable discharge operation therefore allowing the discharge lamp to readily go out. Consequently, the current dimming mode generally enables a dimming control range of about 100% to 70%.

Under the circumstances, a discharge lamp lighting apparatus is disclosed which employs a current dimming mode as a control means to dynamically adjust the screen brightness according to continually changing input signals, in combination with a burst dimming mode as a control means to adjust the screen brightness based on the user's operation (refer to, for example, Japanese Patent Application Laid-Open No. 2001-357995).

FIG. 6 is a circuit diagram of an exemplar of such a discharge lamp lighting apparatus as described above, and FIG. 7 is a waveform diagram to explain the operation of the discharge lamp lighting apparatus of FIG. 6.

The discharge lamp lighting apparatus of FIG. 6 for lighting a discharge lamp (CFL) 1 includes a DC-AC inverter 2 to supply a driving current to the discharge lamp (CFL) 1, an input section 3 provided with a brightness adjusting means, and a main control section 4 which has a port terminal to output a pulse width modulation (PWM) signal to the inverter 2 in response to the output sent from the input section 3, and also a digital-analog (D-A) terminal to output a reference current value to the DC-AC inverter 2 in response to the output sent from the input section 3.

The discharge lamp lighting apparatus of FIG. 6 performs a dimming operation as follows. Referring to FIG. 7, if a user operates to cause the input section 3 to function to gradually decrease the brightness of the CFL 1 from its maximum level, the main control section 4 functions to gradually decrease the reference current outputted from the D-A terminal until it comes down to a predetermined value. During this process, the output from the port terminal is represented as a PWM signal with 100% on duty (refer to period TK1 in FIG. 7). Then, if the user's operation demands further decrease of the brightness of the CFL 1, the main control section 4 functions to stepwise decrease the on-duty time of the PWM signal outputted from the port terminal while the reference current outputted from the D-A terminal is maintained at the predetermined value (refer to period TK2 in FIG. 7).

Thus, in the discharge lamp lighting apparatus of FIG. 6, the current dimming mode is performed until the reference current, which is outputted from the D-A terminal, comes down to arrive at the predetermined value, and if the reference current having arrived at the predetermined value is caused to further decrease, then the burst dimming mode is performed with the reference current maintained at the predetermined value, whereby a wide range of dimming operation is enabled without causing a brightness gradient as shown in FIG. 5.

Under the circumstances, a large LCD, which has been recently developed for use in, for example, a large television, requires an increasingly longer discharge lamp (e.g., a cold cathode tube), and such an elongated long discharge lamp tends to cause a brightness gradient between the high tension side and the low tension side of the lamp even if the lamp current value is within the guarantee value of the discharge lamp. Consequently, if the current dimming mode is performed in the discharge lamp lighting apparatus of FIG. 6 such that the lamp current is decreased down to the reference current value, there is still a likelihood that the brightness gradient as shown in FIG. 4 will be caused at the CFL 1.

SUMMARY OF THE INVENTION

The present invention has been made in light of the above problem, and it is an object of the present invention to provide a discharge lamp lighting apparatus which includes a dimmer circuit provided with a control means to dynamically control screen brightness according to an input signal and also provided with a control means to control screen brightness based on the user's manipulation, and in which the dimmer circuit enables a dimming operation to be performed over a wide range without generating a brightness gradient between the high tension side and the low tension side of a discharge lamp even if the discharge lamp is long.

In order to achieve the object described above, according to an aspect of the present invention, there is provided a discharge lamp lighting apparatus which includes a dimmer circuit provided with a control means to dynamically adjust screen brightness according to an input signal, and a control means to adjust screen brightness based on a user's operation, and the dimmer circuit includes: an amplitude adjusting circuit to superpose a first dimming control signal composed of a DC voltage onto a second dimming control signal composed of a pulse width modulation signal; an integration circuit to integrate the output of the amplitude adjusting circuit; and a comparison circuit to compare the output of the integration circuit with a triangular wave having a predetermined frequency thereby generating a dimming signal, wherein a burst dimming mode is performed according to the dimming signal.

With the structure described above, the discharge lamp lighting apparatus is adapted, without performing a current dimming mode according to the first dimming control signal composed of a DC voltage, to perform a burst dimming mode of a discharge lamp according to the newly generated dimming signal which has the first dimming control signal reflected in the second dimming control signal. Consequently, a dimming operation can be performed with the peak lamp current of a discharge lamp maintained constantly at the peak current value provided for establishing the dimming level of 100%, a dimming operation can be performed over a wide range without generating a brightness gradient between the high tension and low tension sides of a discharge lamp even if the discharge lamp is long, and at the same a cold start performance is improved.

In the aspect of the present invention, the dimmer circuit may further include a digital-analog converting circuit, and the first dimming control signal may be generated such that an external digital signal is converted by the digital-analog converting circuit.

In the aspect of the present invention, the first dimming control signal may be an external analog signal.

In the aspect of the present invention, the second dimming control signal may be an external signal inputted based on the user's operation.

Thus, according to the present invention, in the discharge lamp lighting apparatus including a dimmer circuit which is provided with a control means to dynamically adjust screen brightness according to an input signal and also a control means to adjust screen brightness based on a user's operation, the dimmer circuit enables a dimming operation to be performed over a wide range without generating a brightness gradient between the high tension and low tension sides of a discharge lamp even if the discharge lamp is long.

DETAILED DESCRIPTION OF THE INVENTION

An exemplary embodiment of the present invention will be described with reference to the accompanying drawings.

Figure 1:
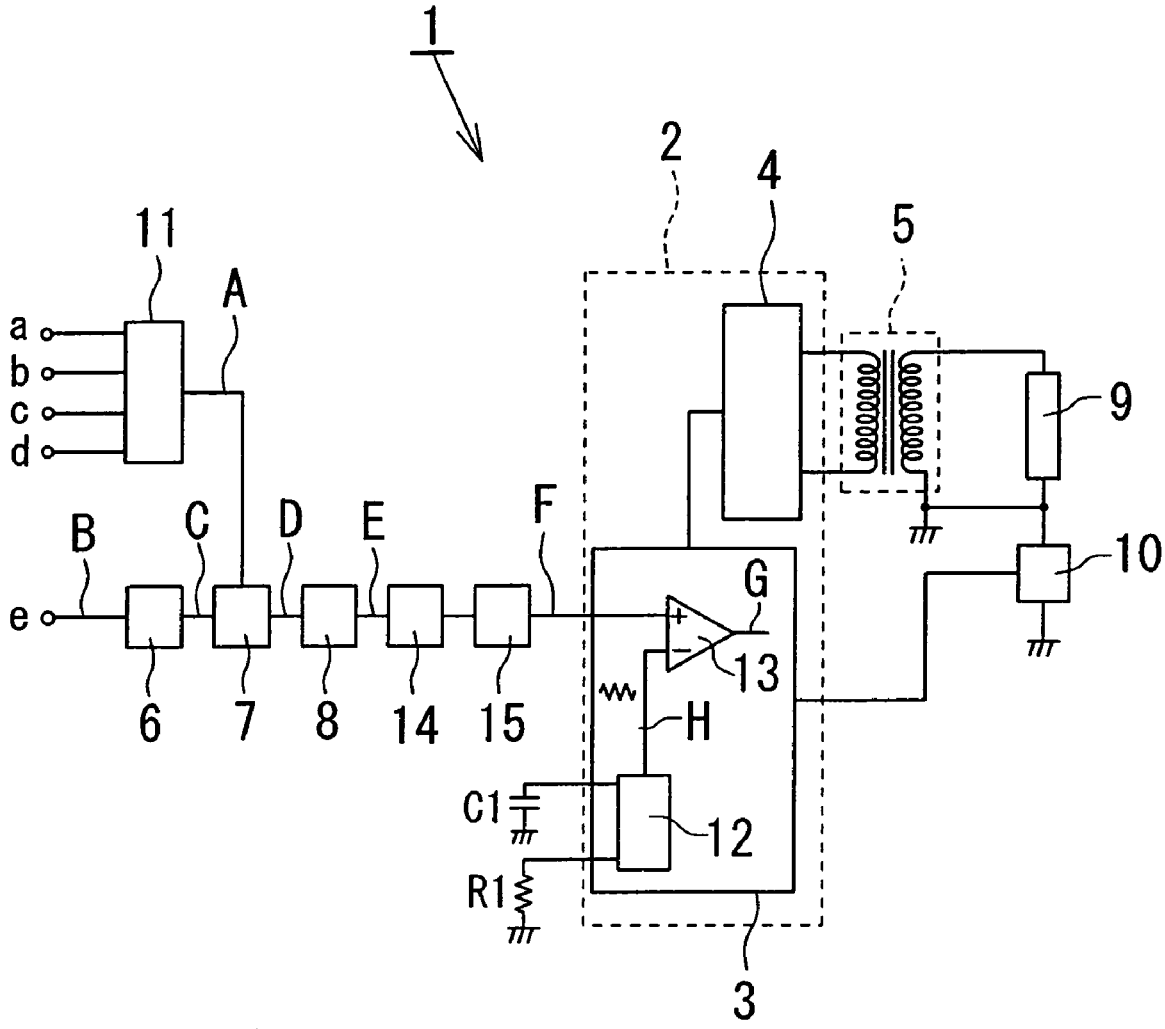
FIG. 1 is a circuit diagram of a discharge lamp lighting apparatus according to an embodiment of the present invention.

Referring to FIG. 1, a discharge lamp lighting apparatus 1 according to an embodiment of the present invention includes an inverter circuit 2, and a step-up transformer 5. The inverter circuit 2 includes a switch circuit 4 to drive the primary side of the step-up transformer 5, and a control circuit 3 to control the operation of the switch circuit 4. A discharge lamp 9, such as a cold cathode tube, is connected at the secondary side of the step-up transformer 5, and one terminal of the discharge lamp 9 is grounded via a lamp current detecting circuit 10. The discharge lamp lighting apparatus 1 according to the present embodiment is adapted to control lighting of the discharge lamp 9 and is used as a backlight device for an LCD (not shown).

A dimmer circuit in the discharge lamp lighting apparatus 1 will hereinafter be described. The dimmer circuit of the discharge lamp lighting apparatus 1 is composed principally of the aforementioned control circuit 3 provided with a dimmer oscillator 12 and a comparison circuit 13, an amplitude adjusting circuit 7, and an integration circuit 8. The output of the dimmer oscillator 12 is connected to the inverting input terminal of the comparison circuit 13, the non-inverting input terminal of the comparison circuit 13 is connected, via a resistance voltage dividing circuit 15, a buffer circuit 14, and the integration circuit 8, to the amplitude adjusting circuit 7. The amplitude adjusting circuit 7 has two input terminals, one of which is connected via a waveform shaping circuit 6 to an external signal input terminal e, and the other one of which is connected via a digital-analog (D-A) converting circuit 11 to external signal input terminals a, b, c and d.

External signals inputted via the external input terminals a to d are, for example, 4-bit digital signals outputted from a controller (not shown) of the LCD and adapted to dynamically adjust the screen brightness of the LCD. The 4-bit digital signals are converted by the D-A converting circuit 11 into a DC voltage A (a first dimming control signal according to the present embodiment) with a voltage corresponding to a 4-bit binary value, and the DC voltage A is outputted to the amplitude adjusting circuit 7. On the other hand, a PWM signal B (a second dimming control signal according to the present embodiment) which has its on-duty cycle adjusted in response to the dimming demand based on a user's operation so as to adjust the screen brightness based on the user's operation is inputted via the external input signal terminal e.

The control circuit 3, the D-A converting circuit 11, the amplitude adjusting circuit 7, and the integration circuits 8, in combination, function as a control means to dynamically adjust the screen brightness according to the input signals from the external signal input terminals a to d, and also function as a control means to adjust the screen brightness based on the user's operation performed according to the input signal from the external signal input terminal e.

The dimming operation of the discharge lamp lighting apparatus 1 will be described below. In the present embodiment, it is assumed that the 4-bit digital signals, which are inputted to the D-A converting circuit 11 via the external signal input terminals a to d, are converted into respective DC voltages A ranging, for example, from 3.0 V down to 2.25 V. A DC voltage A of 3.0 V is provided for establishing the maximum dimming level of 100% (all of the 4-bit digital signals are at a high (H) level), and a DC voltage A of 2.25 V is provided for establishing the minimum dimming level of 75% (all of the 4-bit digital signals are at a low (L) level).

Description will first be made on the dimming operation of the discharge lamp lighting apparatus 1 in the case where there is no dimming demand based on the user's operation.

FIGS. 2A to 2F are waveform charts to schematically show the dimming operation of the discharge lamp lighting apparatus 1 when there is no dimming demand based on the user's operation, wherein the 4-bit digital signals sent from the controller of the LCD so as to establish the dimming level ranging from 100% to 75% are inputted to the external signal input terminals a to d.

Figure 2:
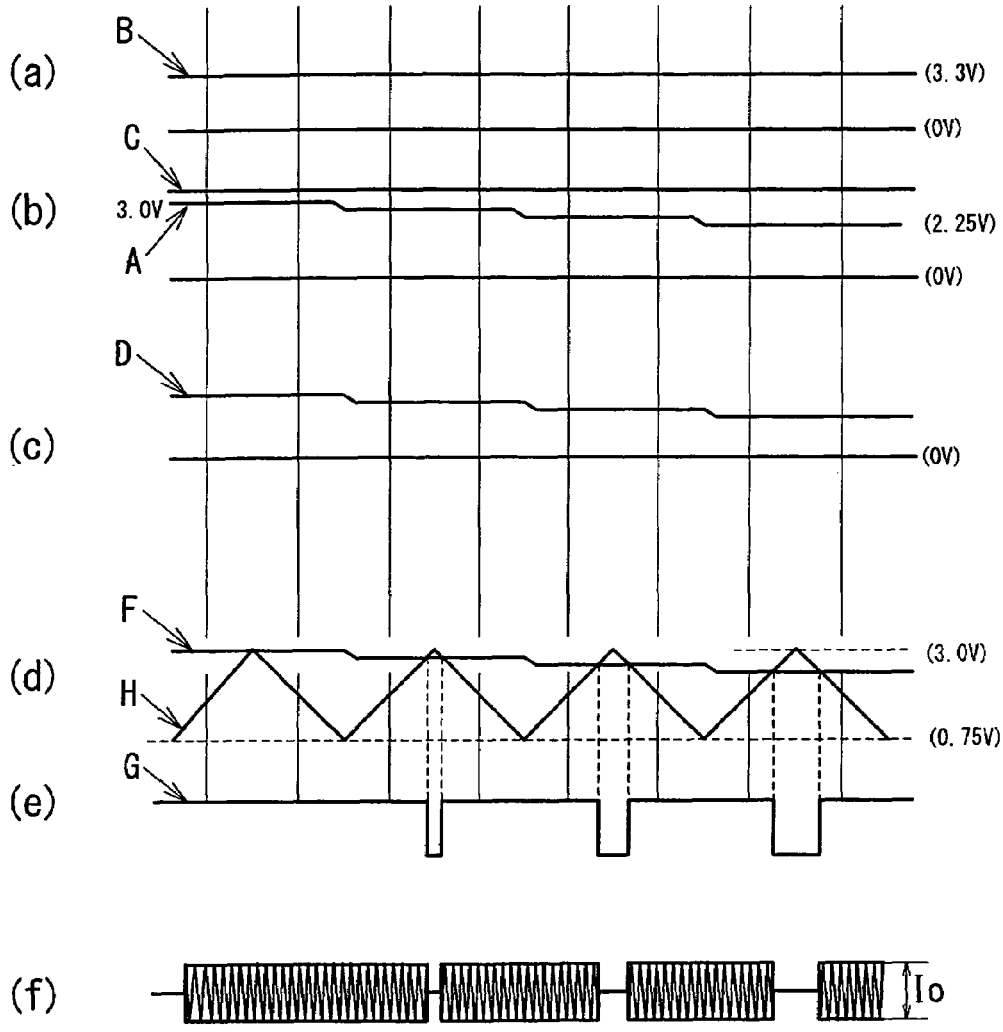
FIGS. 2A to 2F are waveform charts to schematically show a dimming operation of the discharge lamp lighting apparatus of FIG. 1 when there is no dimming command based on a user's operation.

Referring to FIG. 2A showing the PWM signal B inputted to the external signal input terminal e, since there is no demand for decrease of brightness based on the user's operation, the PWM signal B is a DC signal with 100% on duty. The PWM signal B may possibly have difference in voltage of its amplitude value depending on the external circuit setting, and so in the present invention it is assumed that the PWM signal B has its amplitude value compared with a reference voltage at the waveform shaping circuit 6 and shaped with a specific voltage (5.0 V, for example), and then is outputted to the amplitude adjusting circuit 7 as a PWM signal C which, in this case, is represented as a DC signal C as shown in FIG. 2B.

Figure 3:
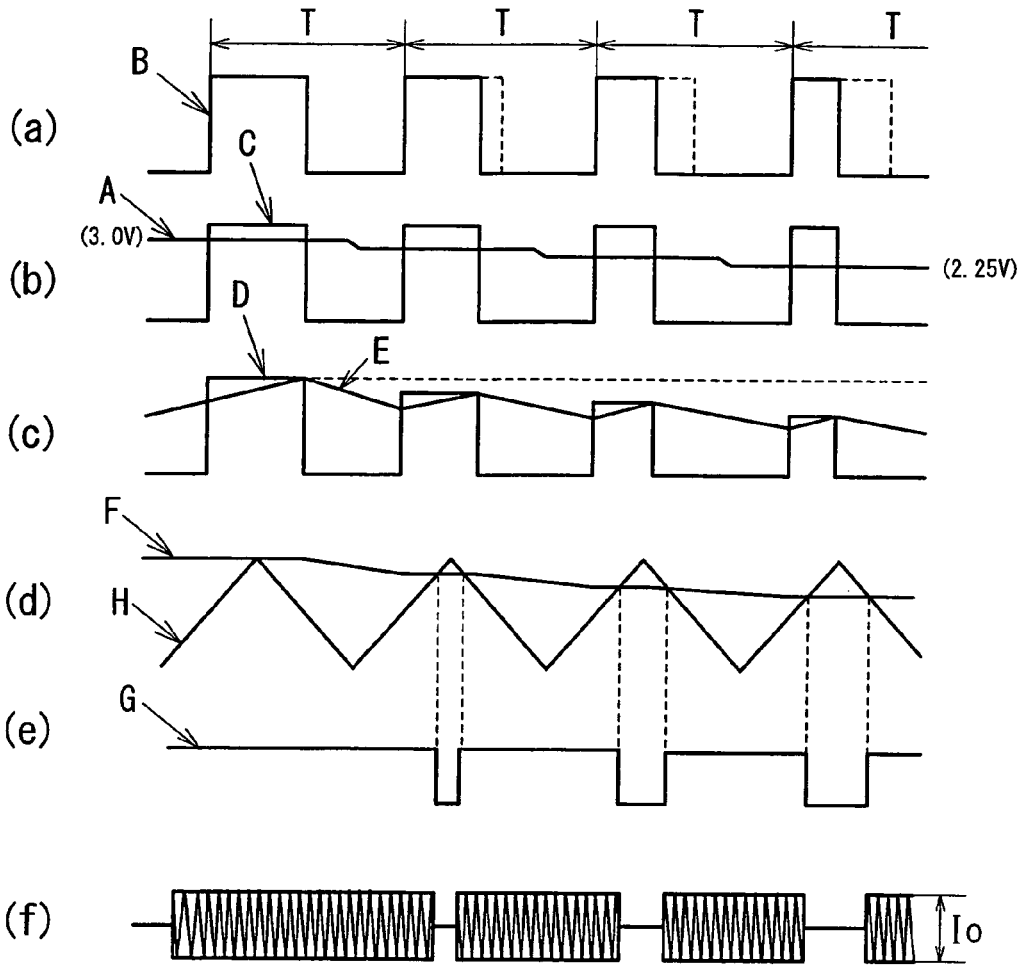
FIGS. 3A to 3F are waveform charts to schematically show a dimming operation of the discharge lamp lighting apparatus of FIG. 1 when there is a dimming command based on a user's operation.
Figure 4:
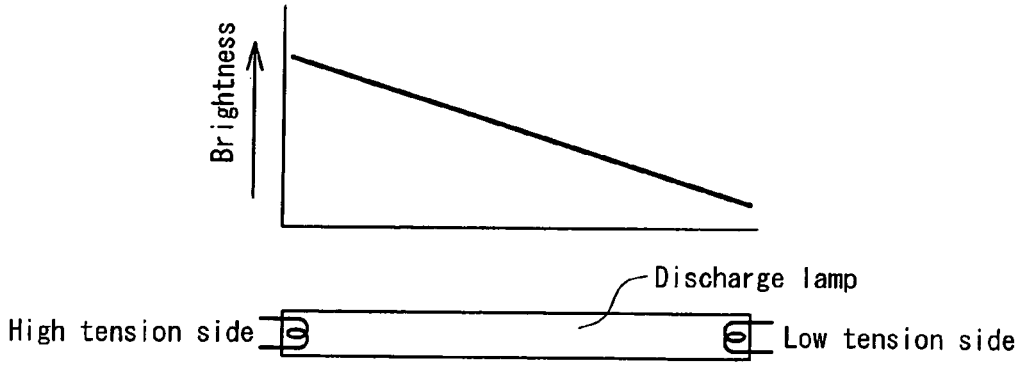
FIG. 4 is an explanatory view of a brightness gradient caused at a discharge lamp in a current dimming mode.
Figure 5:
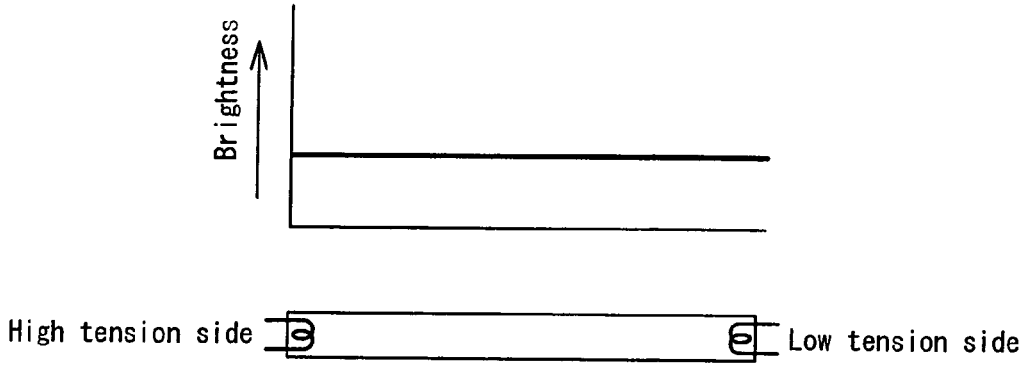
FIG. 5 is an explanatory view of no brightness gradient caused at a discharge lamp.
Figure 6:
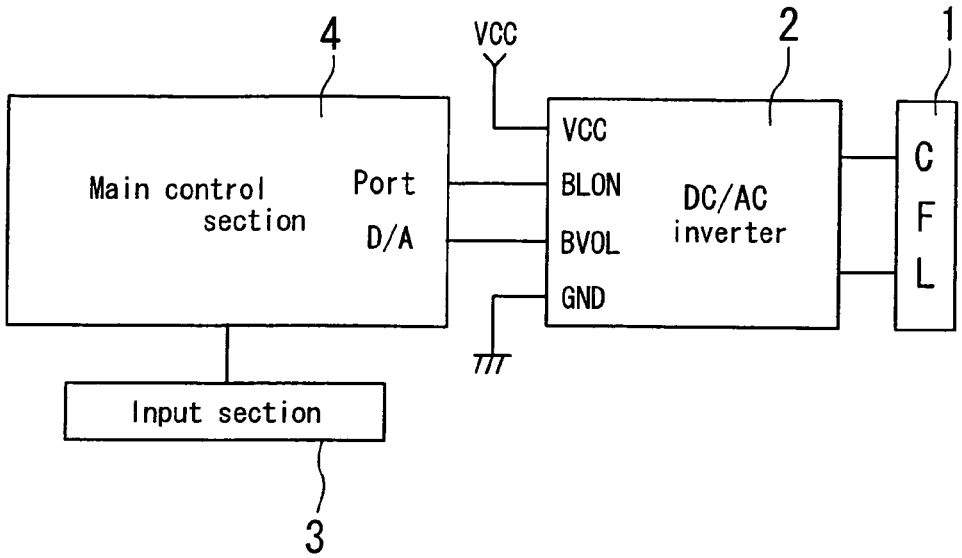
FIG. 6 Prior Art
FIG. 6 is a block diagram of a conventional discharge lamp lighting apparatus including a dimmer circuit.
Figure 7:
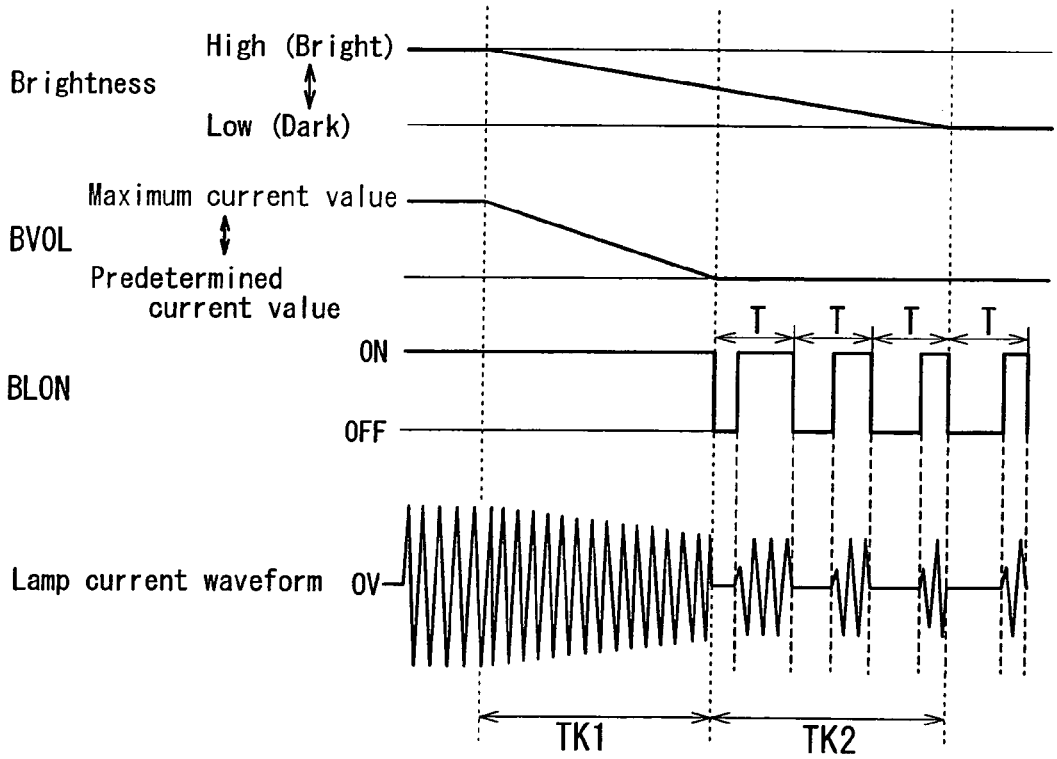
FIG. 7 Prior Art
FIG. 7 covers waveform charts to schematically show a dimming operation of the discharge lamp lighting apparatus of FIG. 6.

The 4-bit digital signals adapted to decrease brightness in accordance with the dimming range of 100% to 75% are inputted to the external signal input terminals a to d, and the DC voltage A whose voltage decreases stepwise at respective time points in response to the 4-bit digital signals as shown in FIG. 2B is outputted from the D-A converting circuit 11 to the amplitude adjusting circuit 7. The amplitude adjusting circuit 7 superposes the DC voltage A outputted from the D-A converting circuit 11 onto the PWM signal C outputted from the waveform shaping circuit 6, and outputs to the integration circuit 8 a signal D which has its amplitude value adjusted according to the DC voltage A as shown in FIG. 3C.

The signal D containing the DC voltage A superposed is integrated by the integration circuit 8 and outputted as a signal E. The signal E is sent via a buffer circuit 14 to a resistance voltage dividing circuit 15, divided thereat and outputted as a signal F (refer to FIG. 2D) which is to be inputted to the non-inverting input terminal (+) of the comparison circuit 13 provided in the control circuit 3. On the other hand, a triangular wave signal H (refer to FIG. 2D) which is outputted from the dimmer oscillator 12 is inputted to the inverting input terminal (−) of the comparison circuit 13, then the comparison circuit 13 outputs a PWM signal G (refer to FIG. 2E) whose low levels appear at periods where the voltage of the triangular wave signal H exceeds the voltage of the signal F, as shown in FIGS. 2D and 2E.

In the discharge lamp lighting apparatus 1, the PWM signal G is utilized as a dimming signal for the discharge lamp 9. Specifically, the switch circuit 4 is caused to perform an intermittent operation, namely a switching operation, such that the off periods of the operation correspond to the periods of the low levels of the PWM signal G, thus realizing a burst dimming mode. Consequently, when the signal F becomes lower, the on-duty time of the switch circuit 4 is decreased so as to lower the brightness of the discharge lamp 9, and when the signal F becomes higher, the on-duty time of the switch circuit 4 is increased so as to enhance the brightness of the discharge lamp 9. Referring to FIG. 2F showing a lamp current flowing in the discharge lamp 9, the burst dimming mode is performed such that the brightness is caused to decrease in response to the lowering of the signal F while the lamp current has its peak current (amplitude) Io maintained at a constant value (specifically, equal to the value provided for establishing the dimming level of 100%). In this connection, the frequency of the triangular wave signal H can be set at a desired value by, for example, changing the values of a resistor R1 and a capacitor C1 externally connected to the control circuit 3.

Description will now be made, with reference to FIGS. 3A to 3F, on the dimming operation of the discharge lamp lighting apparatus 1 in the case where there is a dimming demand based on a user's operation, wherein the 4-bit digital signals sent from the controller of the LCD so as to establish the dimming level ranging from 100% to 75% are inputted to the external signal input terminals a to d.

Referring to FIG. 3A, a PWM signal B, which is inputted to the external signal input terminal e, has its on-duty time decreased according to the demand for brightness reduction based on the user's operation so as to achieve the brightness reduction ranging from 100% to 20%. The PWM signal B may possibly have difference in voltage of its amplitude value depending on the external circuit setting, and so in the present invention it is assumed that the PWM signal B has its amplitude value compared with a reference voltage at the waveform shaping circuit 6 and shaped with a specific voltage (5.0 V, for example), and then is outputted to the amplitude adjusting circuit 7 as a PWM signal C (refer to FIG. 3B). Meanwhile, the 4-bit digital signals adapted to gradually decrease the brightness to the dimming range of 100% to 75% are inputted to the external signal input terminals a to d, and a DC voltage A adapted to decrease stepwise at respective time points according to the 4-bit digital signals as shown in FIG. 3B is outputted from the D-A converting circuit 11 to the amplitude adjusting circuit 7. The amplitude adjusting circuit 7 superposes the DC voltage A outputted from the D-A converting circuit 11 onto the PWM signal C outputted from the waveform shaping circuit 6, and outputs to the integration circuit 8 a PWM signal D (refer to FIG. 3C) which has its amplitude adjusted according to the DC voltage A.

The PWM signal D is integrated by the integration circuit 8 and outputted as a signal E (refer to FIG. 3C). The signal E is sent via the buffer circuit 14 to the resistance voltage dividing circuit 15, divided thereat and outputted as a signal F (refer to FIG. 3D) which is to be inputted to the non-inverting input terminal (+) of the comparison circuit 13 provided in the control circuit 3. Here, since the decrease of the DC voltage A is reflected as a decrease in the amplitude of the PWM signal D at its respective pulses, and since the decrease of the on-duty time of the PWM signal C is reflected directly as the decrease of the on-duty time of the PWM signal D, the signal F which is formed from the integration and division of the PWM signal D constitutes a signal to reflect the variation of both the 4-bit digital signals inputted via the external signal input terminals a to d for dynamically adjusting the screen brightness and the PWM signal B inputted via the external signal input terminal e for adjusting the screen brightness based on the use's operation. On the other hand, a triangular wave signal H (refer to FIG. 3D) which is outputted from the dimmer oscillator 12 is inputted to the inverting input terminal (−) of the comparison circuit 13, then the comparison circuit 13 outputs a PWM signal G (refer to FIG. 3E) whose low levels appear at periods where the voltage of the triangular wave signal H exceeds the voltage of the signal F, as shown in FIGS. 3D and 3E.

In the discharge lamp lighting apparatus 1, the PWM signal G is utilized as a dimming signal for the discharge lamp 9. Specifically, the switch circuit 4 is caused to perform an intermittent operation, namely a switching operation, such that the off-periods of the operation correspond to the periods of the low levels of the PWM signal G, thus realizing a burst dimming mode. Consequently, when the signal F becomes lower, the on-duty time of the switch circuit 4 is decreased so as to lower the brightness of the discharge lamp 9, and when the signal F becomes higher, the on-duty time of the switch circuit 4 is increased so as to enhance the brightness of the discharge lamp 9. Referring to FIG. 3F showing a lamp current flowing in the discharge lamp 9, the burst dimming mode is performed such that the brightness is caused to decrease in response to the lowering of the signal F while the lamp current has its peak current (amplitude) Io maintained at a constant value (specifically, equal to the value provided for establishing the dimming level of 100%).

Thus, the burst dimming mode described above with reference to FIGS. 3A to 3F is based on the variation and crossing of both the 4-bit digital signals inputted via the external signal input terminals a to d for dynamically adjusting the screen brightness and the PWM signal B inputted via the external signal input terminal e for controlling the screen brightness based on the user's operation. In this connection, the triangular wave signal H is controlled so as to repeatedly vary in the range between the value of the DC voltage A for establishing the dimming level of 100% and the value of the DC voltage A for establishing the dimming level of 20%, and the frequency of the triangular wave signal H can be set at a desired value, for example, by changing the values of a resistor R1 and a capacitor C1 externally connected to the control circuit 3.

While the present invention has been illustrated and explained with respect to the exemplary embodiment, it is to be understood that the present invention is by no means limited thereto. For example, FIGS. 2A to 2F, and 3A to 3F explain the case where the DC voltage A is generated such that the digital signals inputted via the external signal input terminals a to d are converted by the D-A converting circuit 11, but if a DC voltage is outputted from a controller as an analog signal to control brightness, then the DC voltage may be inputted directly to the amplitude adjusting circuit 7. Also, the discharge lamp 9, which is straight in the embodiment, may be bent in a U-configuration, or may alternatively be composed of two straight lamps whose respective low tension sides are connected to each other. Further, the switch circuit 4 is preferably a full bridge circuit including four switching elements, but may alternatively be a half bridge circuit or a push pull circuit. Accordingly, the scope of the present invention should be determined by the claims that follow.

What is claimed is:

1. A discharge lamp lighting apparatus comprising a dimmer circuit which is provided with a control means to dynamically adjust screen brightness according to an input signal, and a control means to adjust screen brightness based on a user's operation, the dimmer circuit comprising:

an amplitude adjusting circuit to superpose a first dimming control signal composed of a DC voltage onto a second dimming control signal composed of a pulse width modulation signal;

an integration circuit to integrate an output of the amplitude adjusting circuit;

a comparison circuit to compare an output of the integration circuit with a triangular wave having a predetermined frequency thereby generating a dimming signal, wherein a burst dimming mode is performed according to the dimming signal; and a digital-analog converting circuit, wherein the first dimming control signal is generated such that an external digital signal is converted by the digital-analog converting circuit.

2. A discharge lamp lighting apparatus according to claim 1, wherein the first dimming control signal is an external analog signal.

3. A discharge lamp lighting apparatus according to claim 1, wherein the second dimming control signal is an external signal inputted based on the user's operation.

* * * * *